US007006112B2

(12) United States Patent
Chia et al.

(10) Patent No.: US 7,006,112 B2
(45) Date of Patent: Feb. 28, 2006

(54) METHOD FOR SCALING IMAGE FRAME

(75) Inventors: Pingo Chia, Taipei (TW); Titan Sun, Taipei (TW)

(73) Assignee: Via Technologies, Inc., Taipei (TW)

( * ) Notice: Subject to any disclaimer, the term of this patent is extended or adjusted under 35 U.S.C. 154(b) by 81 days.

(21) Appl. No.: 10/301,400

(22) Filed: Nov. 21, 2002

(65) Prior Publication Data

US 2003/0174148 A1 Sep. 18, 2003

(30) Foreign Application Priority Data

Mar. 15, 2002 (TW) ..... 91104891 A

(51) Int. Cl.
*G09G 5/00* (2006.01)

(52) U.S. Cl. ..... 345/660; 345/3.2; 345/3.3; 345/538; 345/546; 345/547; 348/206; 348/443; 348/445; 348/581; 382/236; 382/277; 382/298; 386/111

(58) Field of Classification Search ..... 345/537, 345/538, 545, 547, 660, 3.2, 3.3; 382/250, 382/236, 291, 277; 386/111; 348/206
See application file for complete search history.

(56) References Cited

U.S. PATENT DOCUMENTS

| | | | | |
|---|---|---|---|---|
| 5,696,698 | A * | 12/1997 | Herluison et al. | 345/557 |
| 5,778,101 | A * | 7/1998 | Hwang | 382/250 |
| 5,898,794 | A * | 4/1999 | Sonohara et al. | 382/166 |
| 5,917,962 | A * | 6/1999 | Chen et al. | 382/291 |
| 6,348,925 | B1 * | 2/2002 | Potu | 345/537 |
| 6,388,711 | B1 * | 5/2002 | Han et al. | 348/441 |
| 6,556,193 | B1 * | 4/2003 | Auld et al. | 345/418 |

* cited by examiner

*Primary Examiner*—Matthew C. Bella
*Assistant Examiner*—Antonio Caschera
(74) *Attorney, Agent, or Firm*—Madson & Metcalf

(57) ABSTRACT

A method for scaling an image frame by an off-screen technology is provided. An image frame consisting of n rows and m columns of data is stored into a storage device. The image frame is divided into a plurality of image portions. Then, the plurality of image portions are picked in sequence to a frame buffer register. An image scaling operation is performed for each picked image portion, and then the scaled image portion is cleared from the frame buffer register.

19 Claims, 14 Drawing Sheets

METHOD FOR SCALING IMAGE FRAME

FIELD OF THE INVENTION

The present invention relates to a method for scaling an image frame, and more particularly to a method for scaling an image frame by using an off-screen technology.

BACKGROUND OF THE INVENTION

In a typical scaling-down/scaling-up procedure for a video image frame, an on-screen resolution technology is employed to process the video image frame by a video system for a real-time display on a screen. Because the number of image frames displayed on the screen per second should be more than 30 to exempt from image delay, the compressed video images are stored in a frame buffer register in a form of a one-way queue, and then processed by the video system for display. One disadvantage thereof is the requirement for a large capacity of frame buffer register able to store considerable data at the same time. Although the image data consisting of a plurality of rows is easy to be compressed or scaled up in the horizontal dimension, it is difficult to be so processed in the vertical dimension. Therefore, the frame buffer register needs to have a memory capacity enough to store the plurality of rows of the image data. For example, when every three rows of image data are to be compressed into one row, the memory size of the frame buffer register should be capable of storing at least three rows of image data at the same time. On the other hand, for a compression rate up to five, i.e. one row from five ones of image data, the memory size of the frame buffer register is required to be capable of storing at least five rows of image data. As a result, the memory size of the frame buffer register has to be large enough for various compression rates, and thus costs a lot. The similar requirement also applies to the scaling-up situation in view of the image quality. Due to an increasing demand of high compressing rate or scaling-up rate and a memory size limitation of the frame buffer register, the scaling-down/scaling-up procedure by means of the on-screen technology will not assure high quality of a displayed image.

SUMMARY OF THE INVENTION

It is an object of the present invention to provide a method for scaling an image frame by using an off-screen technology, for which a frame buffer register of a memory size much smaller than that required by the on-screen resolution technology is enough to achieve the similar purpose, so as to be cost-effective.

In accordance with an aspect of the present invention, there is provided a method for scaling an image frame. A first-dimension and a second-dimension image scaling operations are performed on a first image portion of the stored image frame consisting of n rows and m columns of data. The first image portion includes the first to the pth rows and the first to the qth columns of data, where $1<p\leqq n$ and $1<q\leqq m$. Then, the first-dimension and the second-dimension image scaling operations are performed on a second image portion of the image frame if p is not equal to n. The second image portion including the ath to tth rows and the first to the bth columns of data, where $1<a<t\leqq n$, $t>p$, and $1<b\leqq m$. Afterwards, the first-dimension and the second-dimension image scaling operations are further performed on a third image portion of the image frame if q is not equal to m. The third image portion includes the first to dth rows and the eth to the fth columns of data, where $1<e<f\leqq m$, $f>q$, and $1<d\leqq n$.

Preferably, the scaling operations are performed longitudinally. For instance, if t is not equal to n, an image portion of the image frame including at least the nth row and the first to the gth columns of data, where $1<g\leqq m$, should be performed thereon the first-dimension and the second-dimension image scaling operations after the second image portion but prior to the third image portion will be the one.

Preferably, $g=b=q$, $a=p+1$, and $e=q+1$. More preferably, $t=2p$ and $f=2q$.

Finally, the first-dimension and the second-dimension image scaling operations are performed on an image portion of the image frame including at least the nth row and the mth column of data.

In accordance with the present invention, the first-dimension and the second-dimension image scaling operations are preferably performed for all of the n rows and m columns of the image frame longitudinally. The first row can be the topmost row or the bottommost row, and the first column can be the leftmost column or the right most column the image frame. In addition, the image portions are preferably stored in a one-way queue to proceed the first-dimension and the second-dimension image scaling operations.

Preferably, each selected image portion consists of at least two rows and at least two columns of data to proceed a horizontal dimension and a vertical dimension scaling operations.

In an embodiment, each of the first-dimension and the second-dimension image scaling operations is performed by weighted average, interpolation, extrapolation or a combination thereof.

In accordance with another aspect of the present invention, there is provided a method for scaling an image frame. The image frame is divided into a series of first image portions horizontally adjacent to one another, and each of the first image portions is divided into a series of second image portions vertically adjacent to one another. A first-dimension and a second-dimension image scaling operations are performed on each of the second image portions one by one of the second image portions of the same first image portion and one by one of the first image portions, until all of the second image portions of the first image portions of the image frame complete the first-dimension and second-dimension image scaling operations.

In accordance with another aspect of the present invention, there is provided a method for scaling an image frame. An image frame consisting of n rows and m columns of data is stored into a storage device. The image frame is divided into a plurality of image portions. The first one of the image portions includes at least the first row and the first column of the image frame, a second one of the image portions includes at least the nth row and the first column of the image frame, a third one of the image portions includes the first row and the mth column of the image frame, and a fourth one of the image portions includes the nth row and the mth column of the image frame. Then, the first, second, third and fourth ones of the image portions are picked in sequence from a frame buffer register to be performed thereon an image scaling operation, and then cleared from the frame buffer register.

In an embodiment, the image frame includes a fifth image portion vertically between the first and second ones of the image portions, which is picked following the first one of the image portions and prior to the second one of the image portions. Furthermore, the image frame includes a sixth image portion horizontally between the first and third ones of the image portions, which is picked following the second one of the image portions and prior to the third one of the image portions.

The above objects and advantages of the present invention will become more readily apparent to those ordinarily skilled in the art after reviewing the following detailed description and accompanying drawings, in which:

BRIEF DESCRIPTION OF THE DRAWINGS

FIG. 1(*b*) schematically illustrates a basic concept of the off-screen technology according to the present invention FIGS. 2(*a*) to 2(*j*) illustrate a preferred embodiment of the image-frame scaling method according to the present invention;

DETAILED DESCRIPTION OF THE PREFERRED EMBODIMENT

Figure 1A:
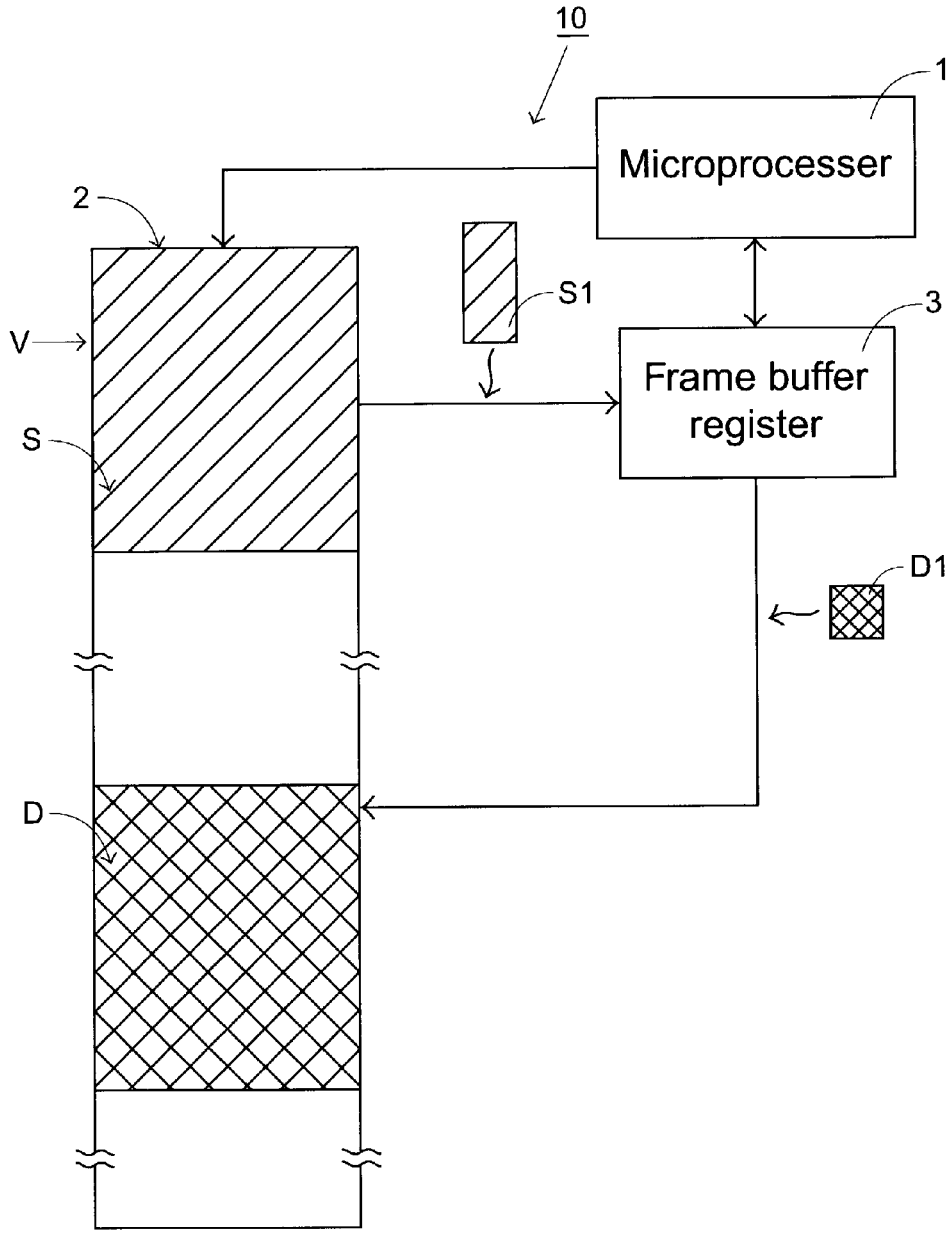
FIG. 1(*a*) is a schematic hardware structure for implementing the image-frame scaling method according to the present invention.
Figure 1B:
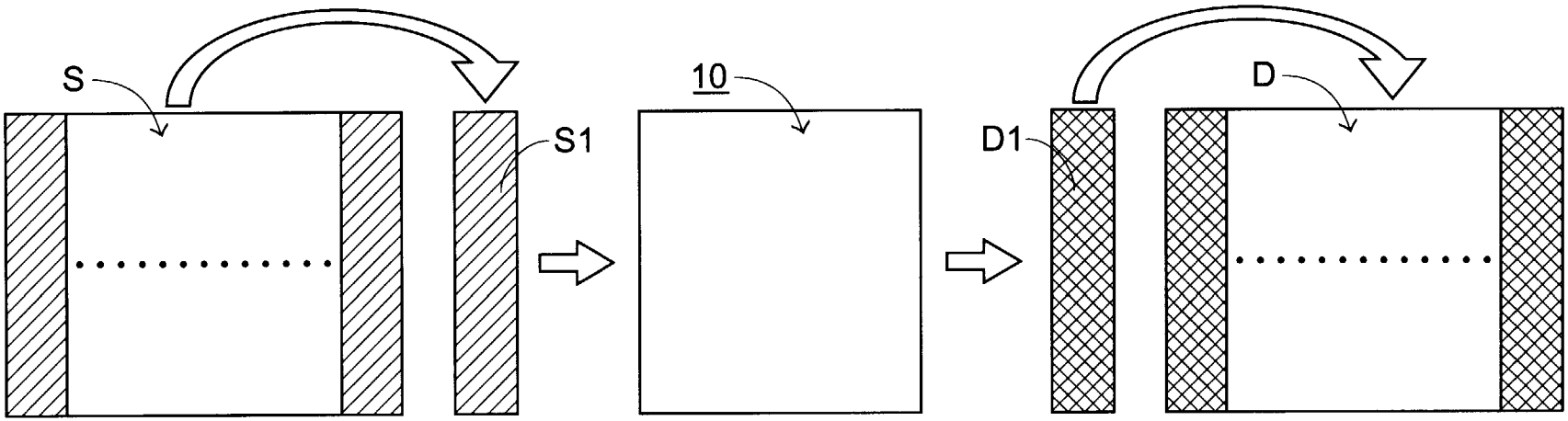
Figure 2A:
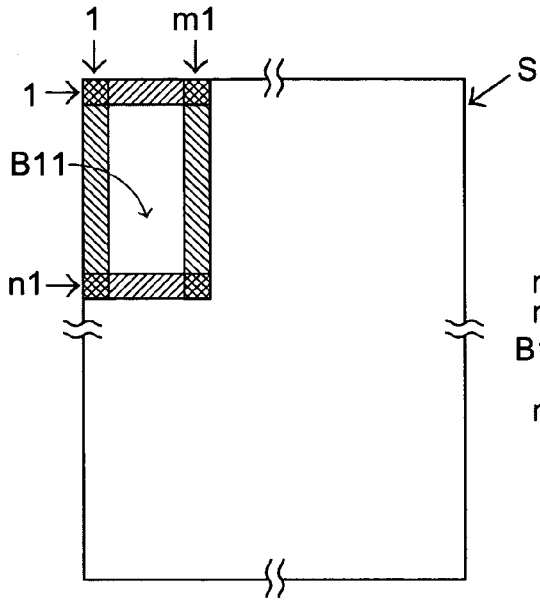
Figure 2B:
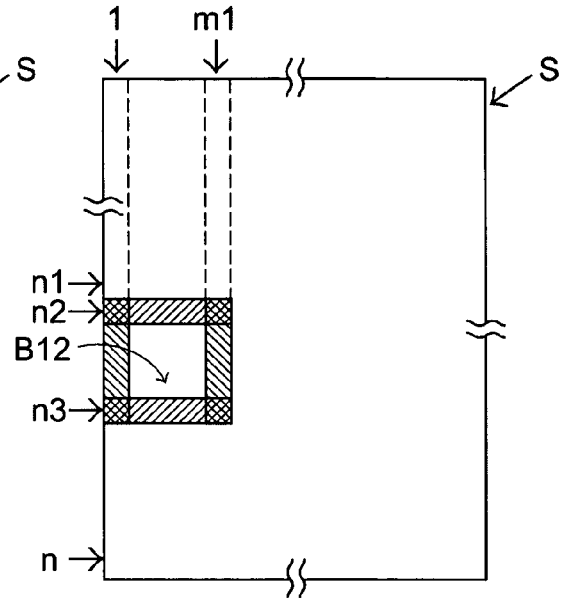
Figure 2C:
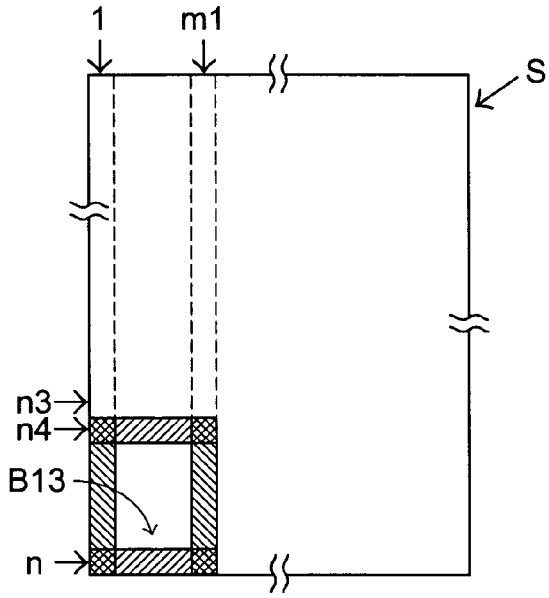
Figure 2D:
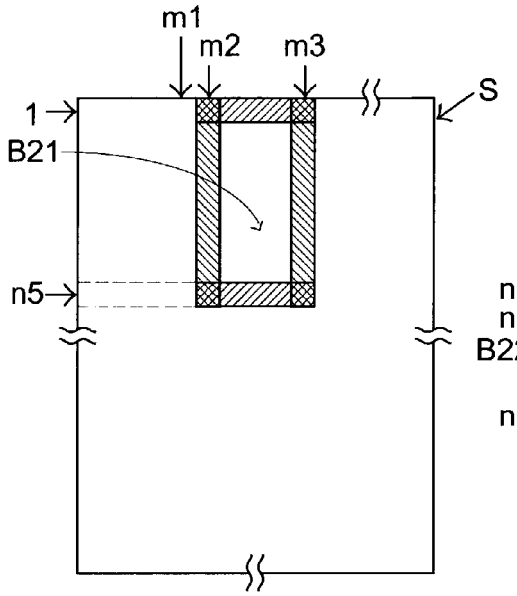
Figure 2E:
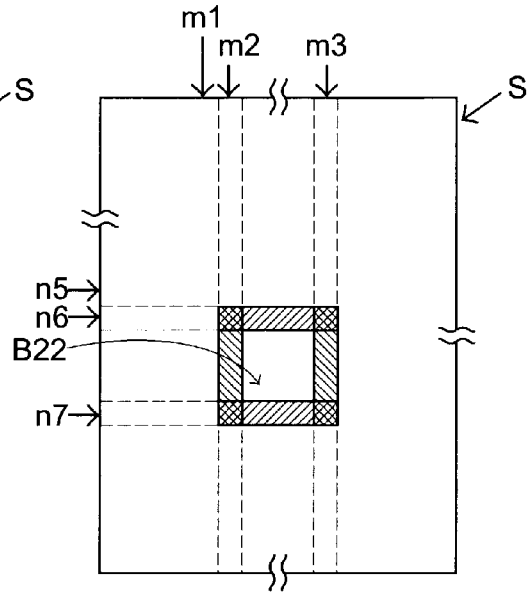
Figure 2F:
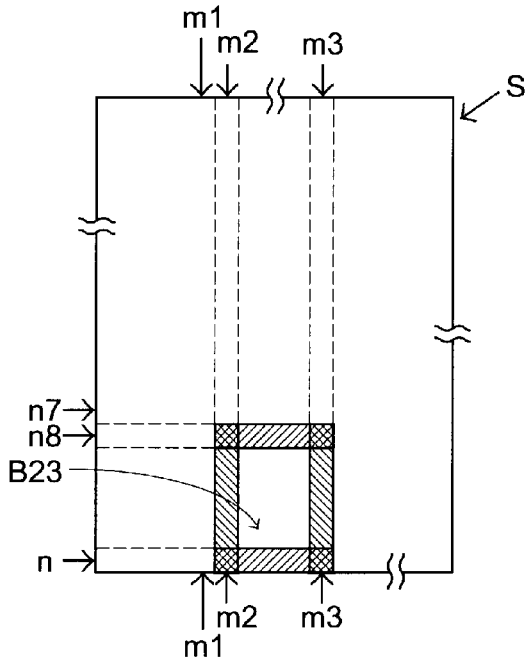
Figure 2G:
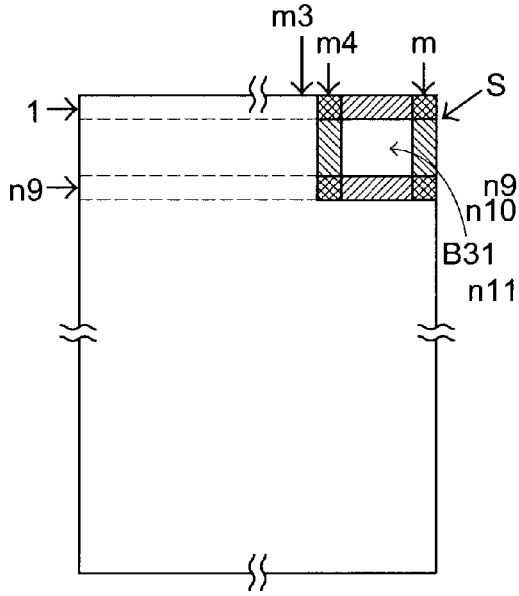
Figure 2H:
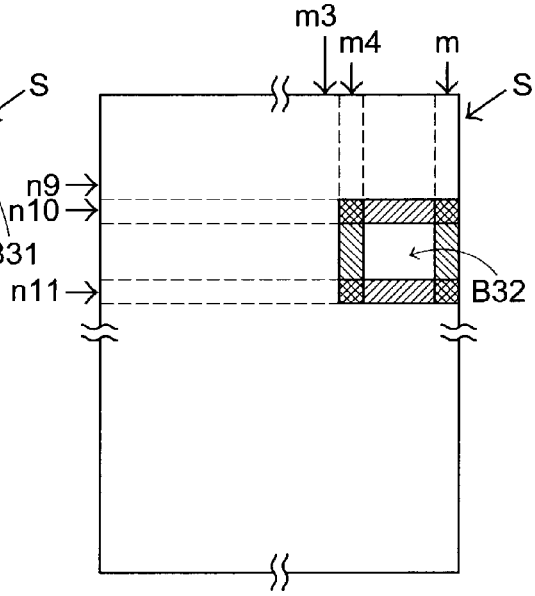
Figure 2I:
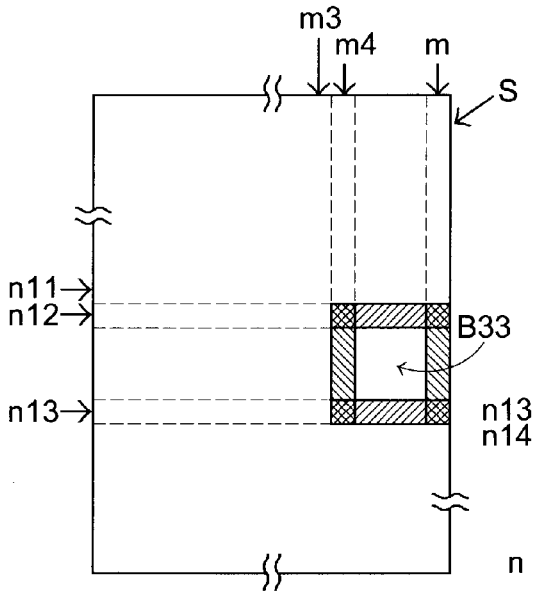
Figure 2J:
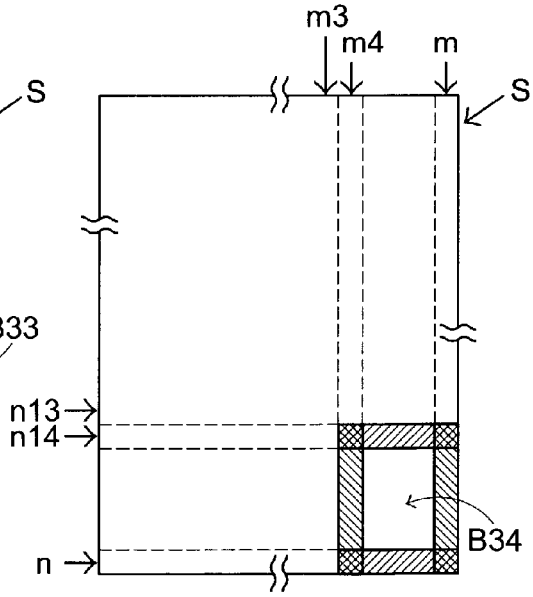

Referring to FIG. 1(*a*), a hardware structure 10 for implementing the method according to the present invention comprises a microprocessor 1, a memory 2 and a frame buffer register 3. The memory 2 stores therein an image frame S, which is composed of image signals V obtained from an image pickup apparatus such as a conventional video imaging apparatus. In addition to the original image frame S, the memory 2 also stores therein an image frame D that is converted from the image frame S. The image frame S are read out from the memory 2 to the frame buffer register 3 to be scaled up or scaled down by the microprocessor 1 portion by portion S1, and the scaled image frame D is stored back to the memory 2 portion by portion D1. The data format in the frame buffer register 3 is preferably queue-based, e.g. in a form of one-way queue. In addition, depending on the demand, the memory size for a queue can be 8×64, 16×64 or 32×64 bits, etc.

FIG. 1(*b*) schematically illustrates a basic concept of the off-screen technology according to the present invention. The image frame S is divided into a plurality of image portions S1 traverse adjacent to one another. The image portions S1 are one by one processed by the system 10 to perform a scaling up or a compressing operation, and the respective scaled image portions D1 are combined to form the scaled image frame D. The data format of the image frame S or the processed image frame D can be selected from YUV422, RGB15, RGB16, RGB32, YCbCr420, and the like.

It is known to a person skilled in the art that the memory size required for the frame buffer register 3 can be considerably reduced due to the relatively small image portion S1 by using such off-screen technology. In addition, the memory size required for the frame buffer register 3 does not have to vary with the compression ratio. Therefore, the frame buffer register required by the present method is more cost-efficient than the prior art. More specifically, the image scaling implementation in a vertical dimension is easier than in the prior art.

Please refer to FIGS. 2(*a*) to 2(*j*), by which a first embodiment of the image-frame scaling method according to the present invention is illustrated. The image frame S consists of n rows and m columns of data, where n and m are integers. The n rows are increasingly numbered from top to bottom, whereas the m columns are increasing numbered from left to right as shown. Initially, the image frame S is stored into the memory 2. First of all, an image frame B11 consisting of the first to the (n1)th rows and the first to the (m1)th columns of data, as shown in FIG. 2(*a*), is picked from the memory 2 into the frame buffer register 3. Then, a horizontal and a vertical image scaling operations are performed on the image frame B11 by the microprocessor 1. Subsequently, another image portion B12 vertically adjacent to the image portion B11 and consisting of the (n2)th to the (n3)th rows and the first to the (m1)th columns, as shown in FIG. 2(*b*), is picked from the memory 2 into the frame buffer register 3 for the horizontal and vertical image scaling operations. Likewise, an image portion B13 consisting of the (n4)th to the last (n)th rows and the first to the (m1)th columns, as shown in FIG. 2(*c*), is picked and scaled. Afterwards, as shown in FIGS. 2(*d*)~2(*f*), image portions B21, B22 and B23 horizontally adjacent to the image portions B11, B12 and B13 and all consisting of the (m2)th to (m3)th columns of data are processed in a manner similar to that implemented on the image portions B11, B12 and B13. Similarly, image portions B31, B32, B33 and B34 shown in FIGS. 2(*g*) to 2(*j*) are one by one picked and performed thereon image scaling operations as above-described.

In accordance with the embodiment, each of the image portions B11, B12, B13, B21, B22, B23, B31, B32, B33 and B34 preferably consists of at least two rows and at least two columns of data. The numbers of rows and/or columns of each image portion are dependent on user's requirement and size of the frame buffer register 3. In order to make the scaled image look more smooth and natural, one or more interfacing rows between two adjacent image portions can be included in both of the image portions to be processed twice. It is also preferred that each of the image portions is of the same size. The horizontal and vertical image scaling operations are known to those skilled in the art. For example, it can be a weighted average, interpolation or extrapolation algorithm, or a combination thereof.

The above embodiment is illustrated by referring to a procedure for processing image portions in a sequence from B11 to B34. It is understood that the processing sequence can also be from B34 to B11 by way of B33, B32, B31, B23, B22, B21, B13 and B12. Alternatively, the sequence can be from B31 to B13 or from B13 to B31.

Figure 3:
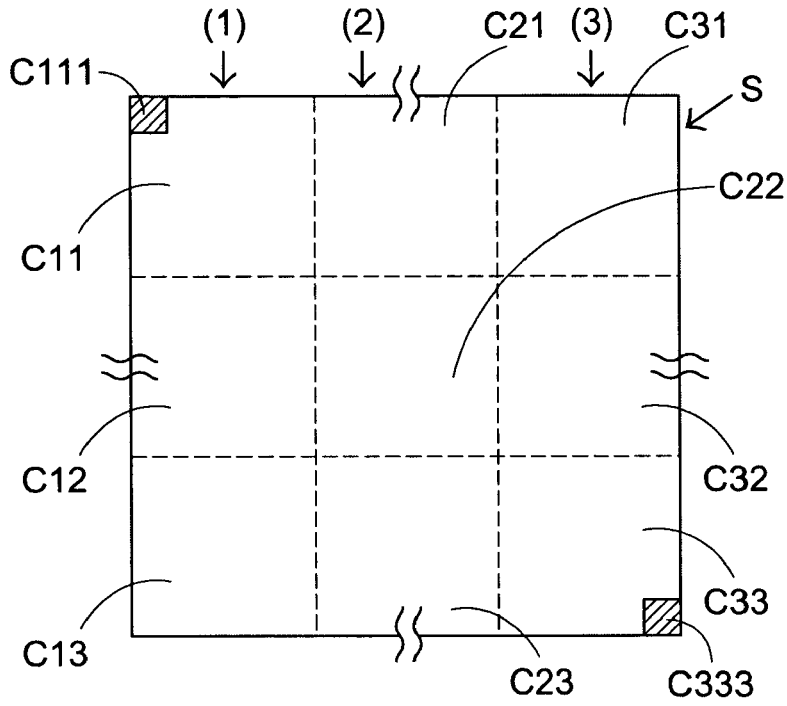
FIG. 3 illustrate another preferred embodiment of the image-frame scaling method according to the present invention.

A second preferred embodiment of the present invention will be illustrated with reference to FIG. 3. An image frame S stored in the memory 2 is divided into three elongated image blocks (1), (2) and (3), which are horizontally adjacent to one another. Each of the image blocks (1), (2) and (3) is further divided into three image portions C11~C13 or C21~C23 or C31~C33, which are vertically adjacent to one another. The image portion C11 contains the first row and the first column of data C111, the image portion C13 contains the last row and the first column of data, the image portion C31 contains the first row and the last column of data, the image portion C33 contains the last row and the last column of data C333, and the combination of all the image portions has to cover the entire image frame S. The procedures for processing theses image portions are analogous to those in the above embodiment shown in FIG. 2. The image portions are processed in a sequence from C11 to C33 by way of C12, C13, C21, C22, C23, C31 and C32.

Figure 4A:
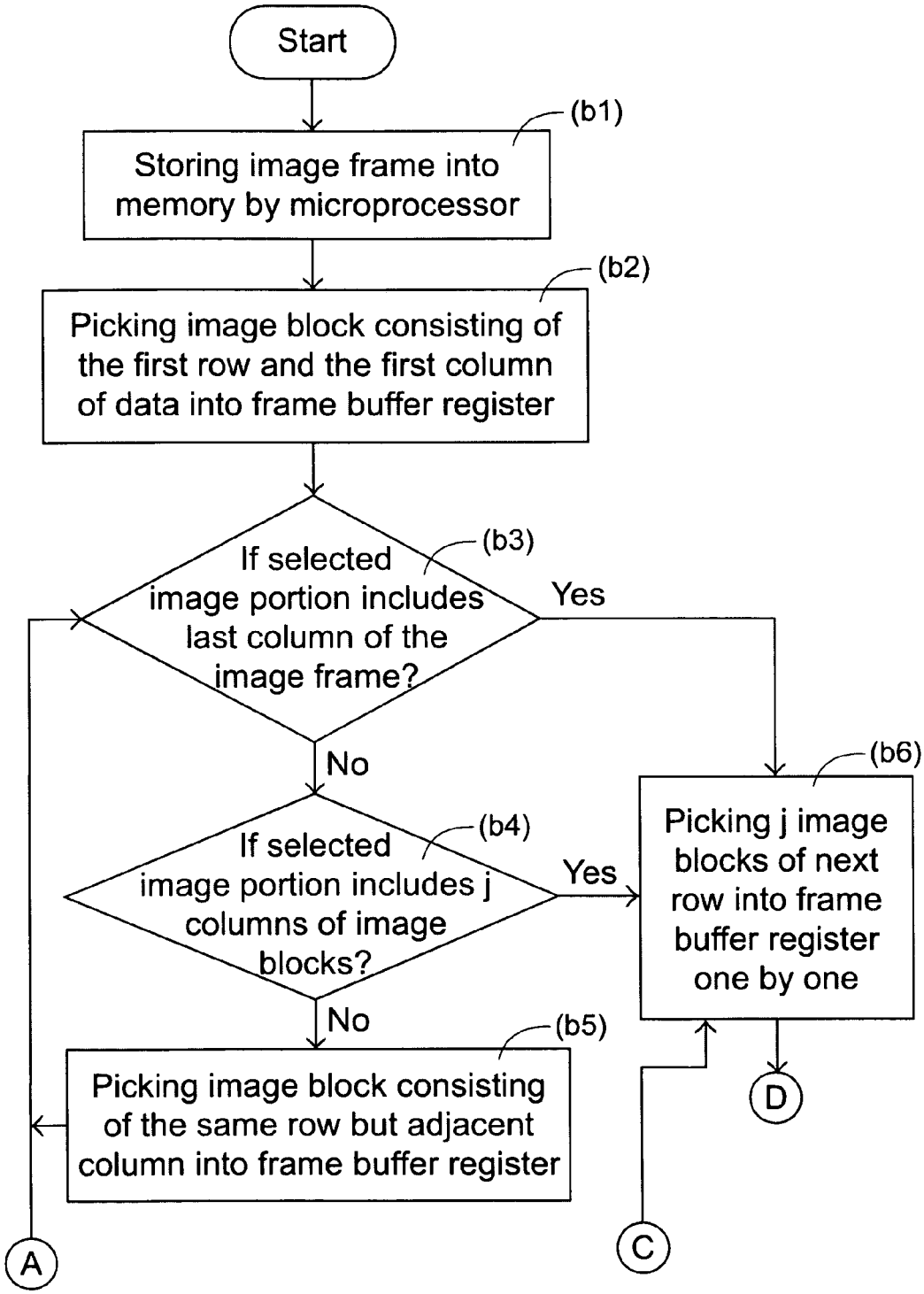
FIGS. 4(*a*) to 4(*c*) are flowcharts illustrating a further preferred embodiment of the image-frame scaling method according to the present invention.
Figure 4B:
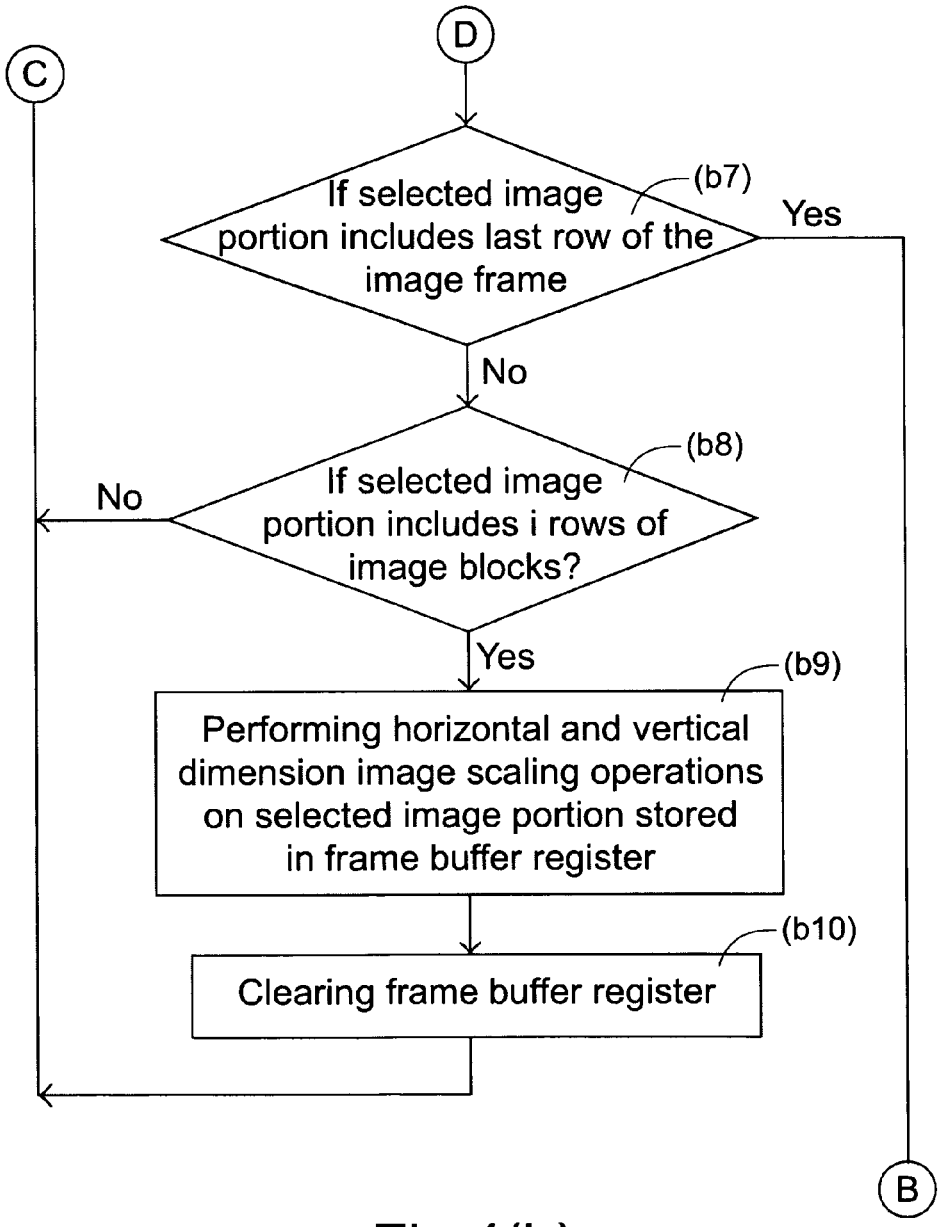
Figure 4C:
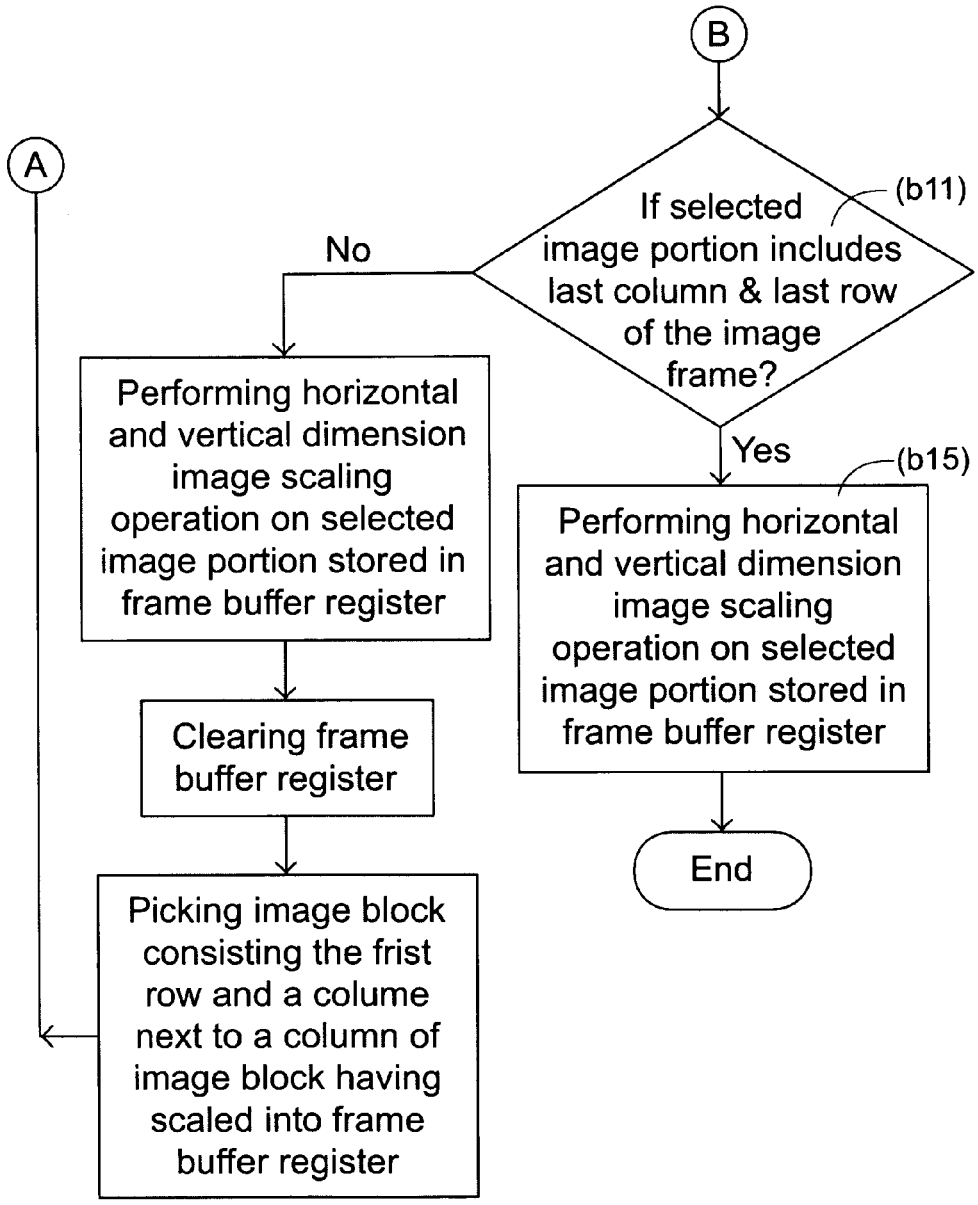
Figure 5A:
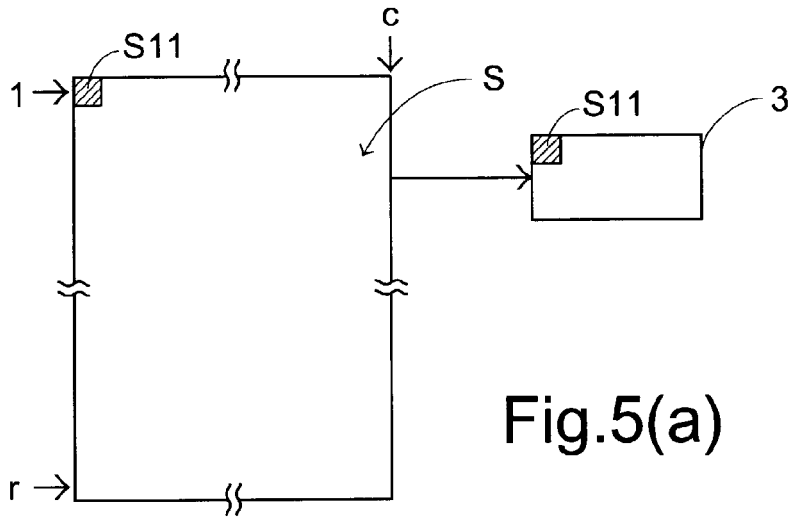
FIGS. 5(*a*) to 5(*n*) are schematic diagrams illustrating the transmission sequences of image portions of an image frame to a frame buffer according to the method of FIGS. 4(*a*)~4(*c*).
Figure 5B:
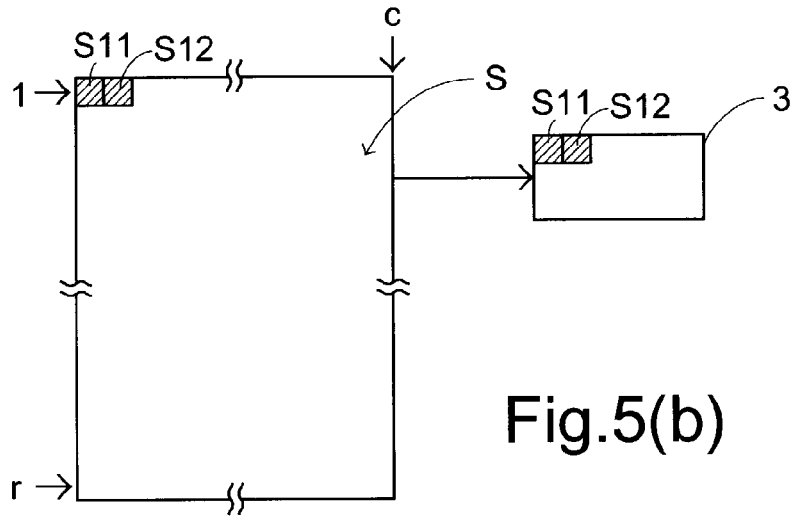
Figure 5C:
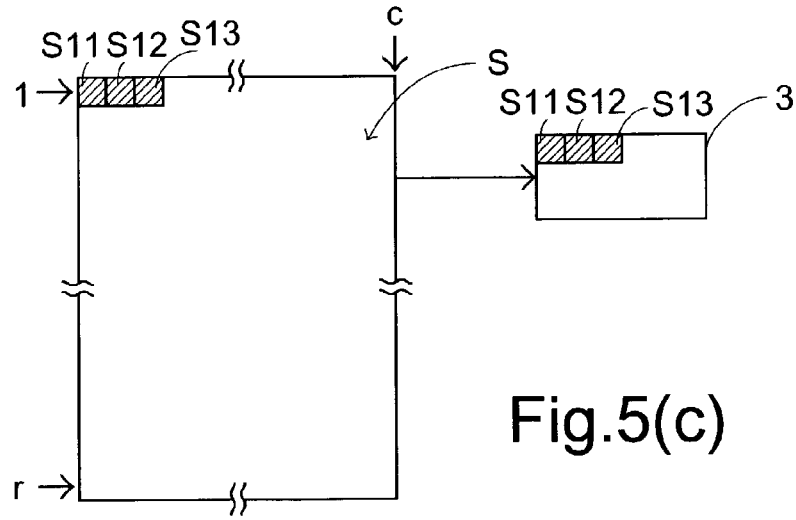
Figure 5D:
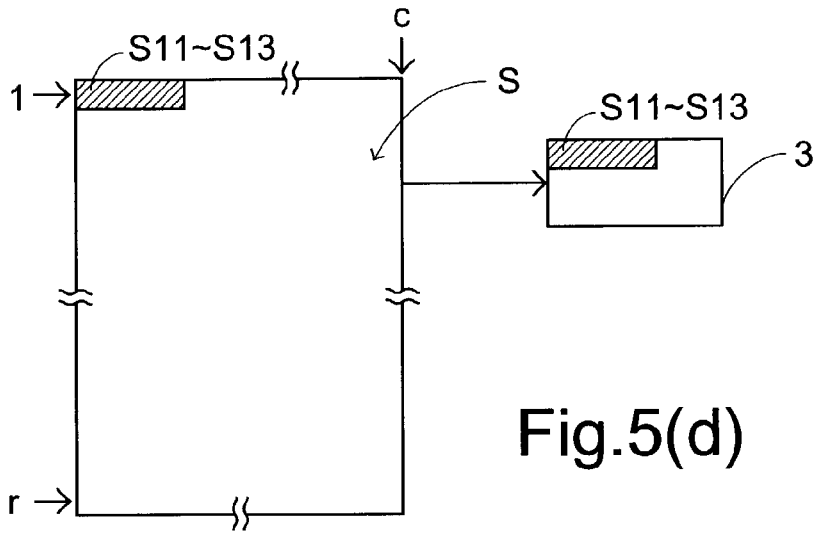
Figure 5E:
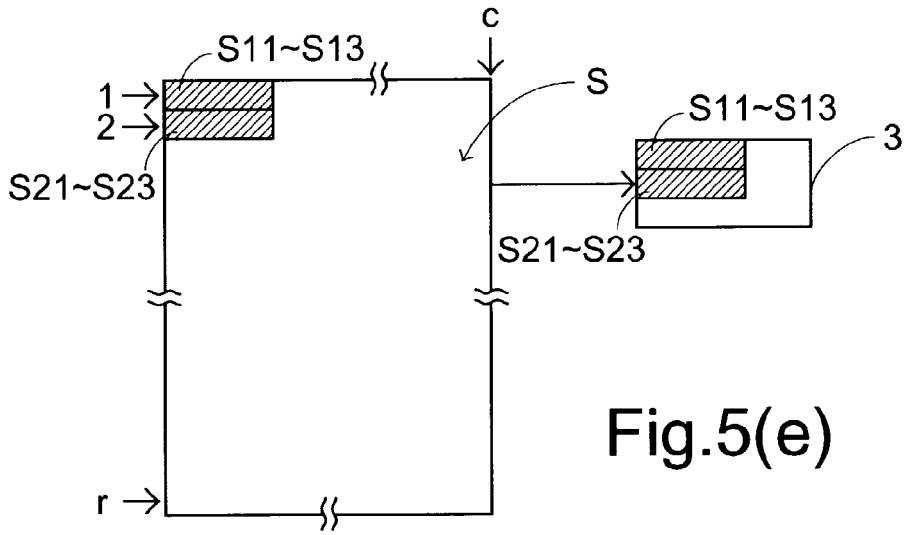
Figure 5F:
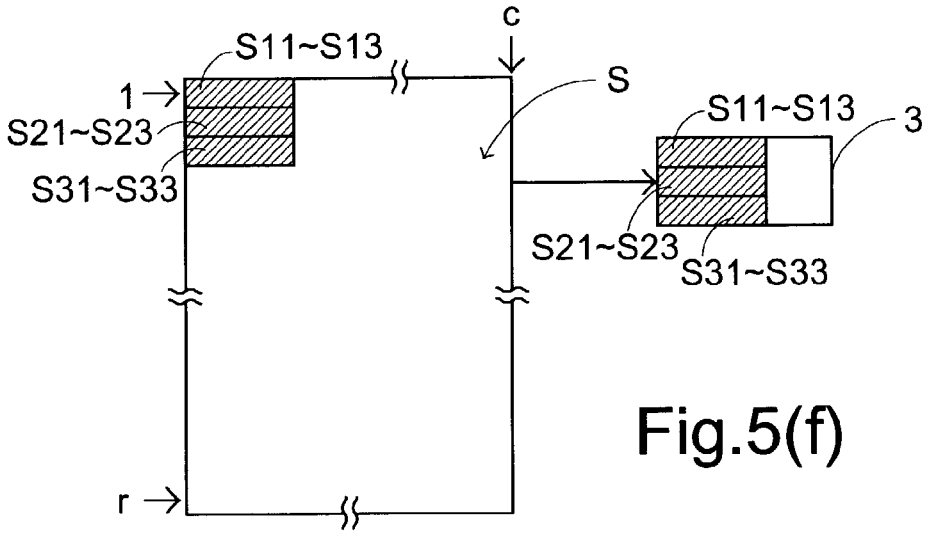
Figure 5G:
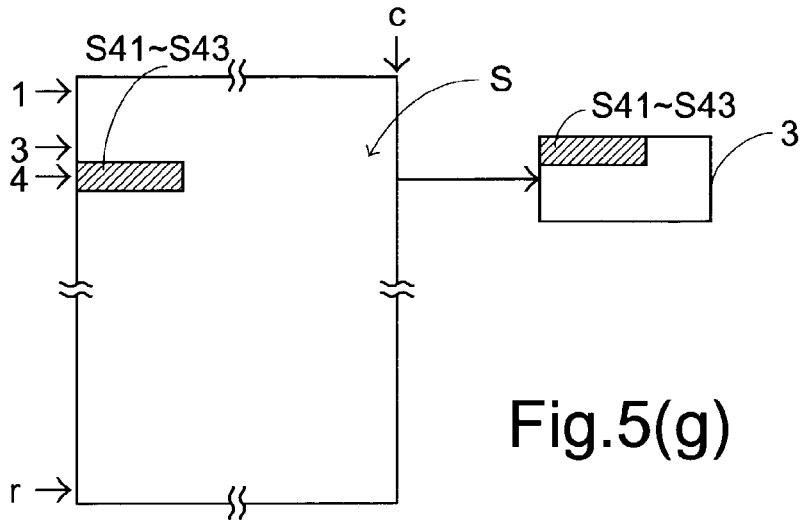
Figure 5H:
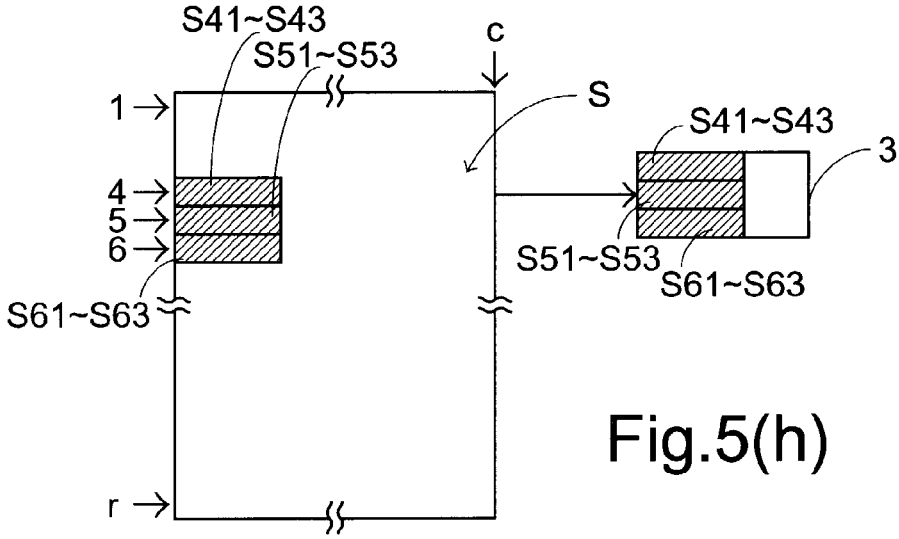
Figure 5I:
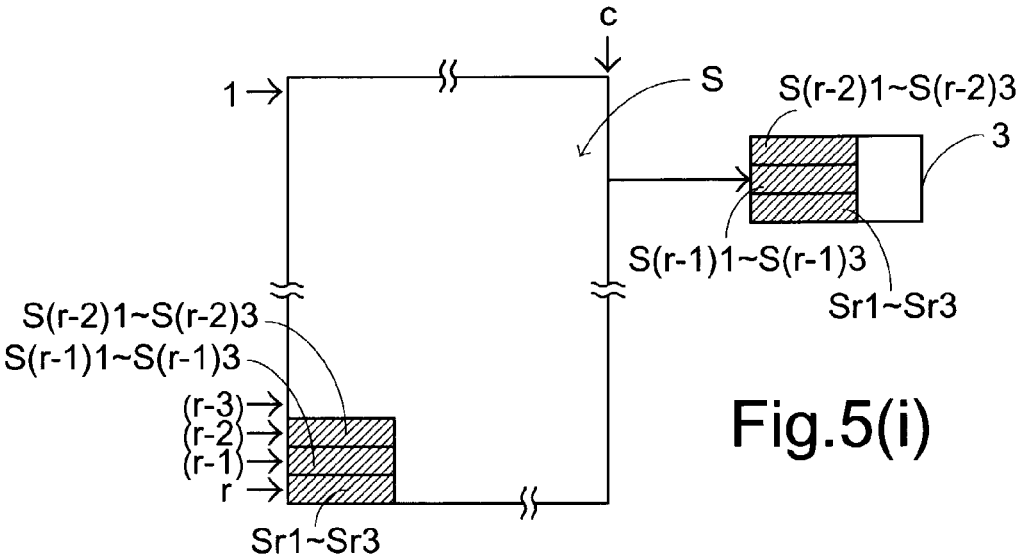
Figure 5J:
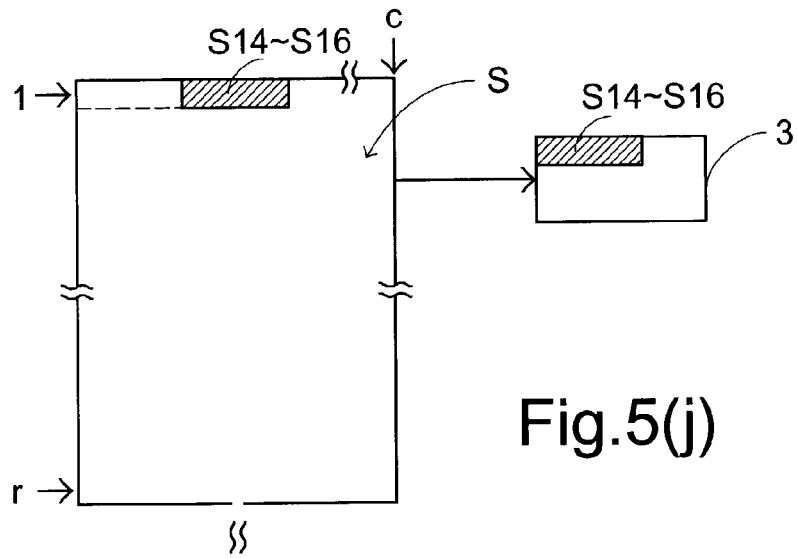
Figure 5K:
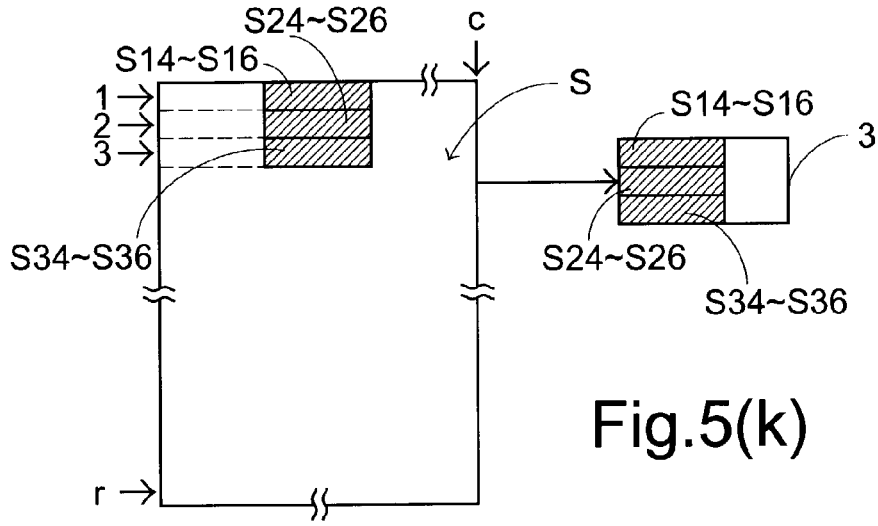
Figure 5L:
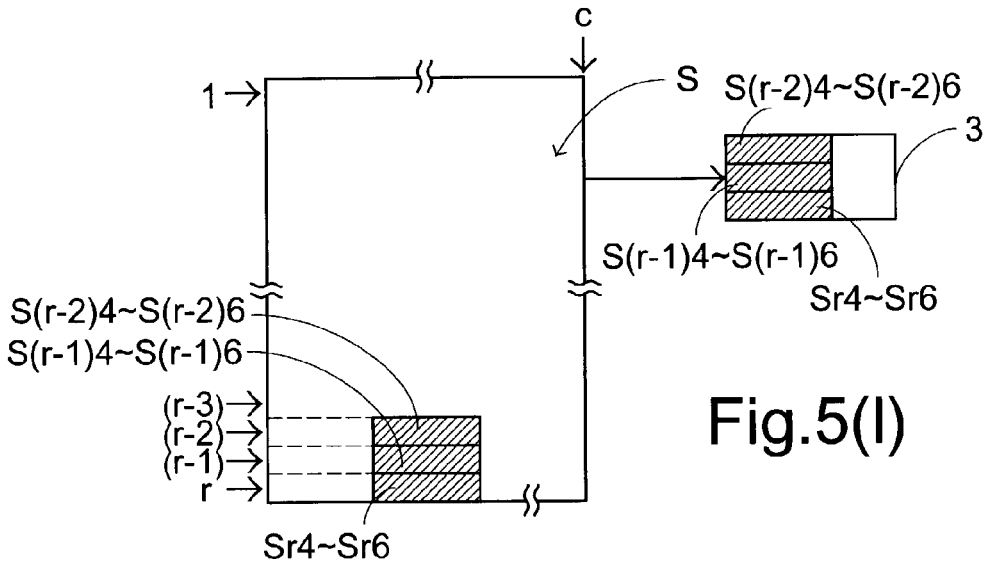
Figure 5M:
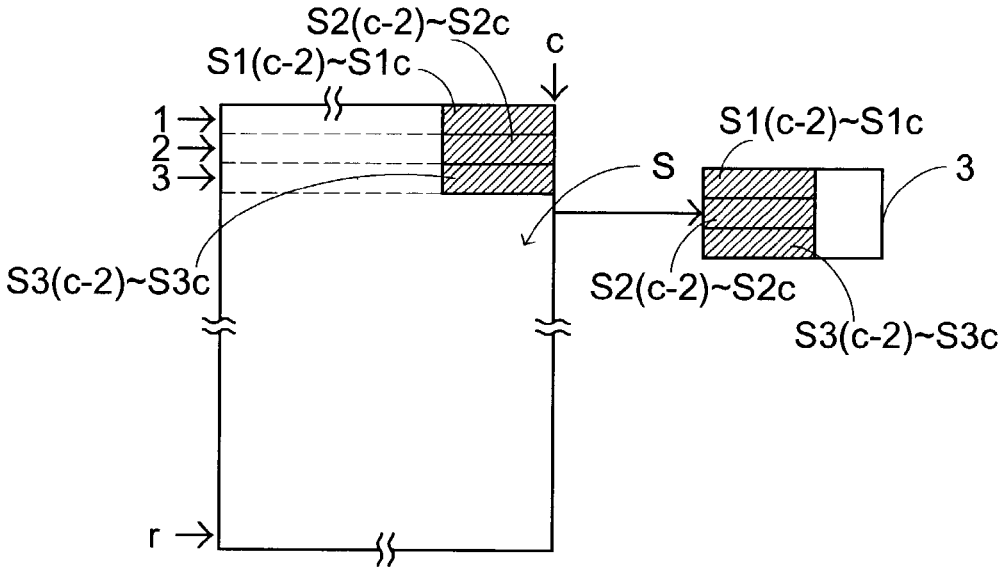
Figure 5N:
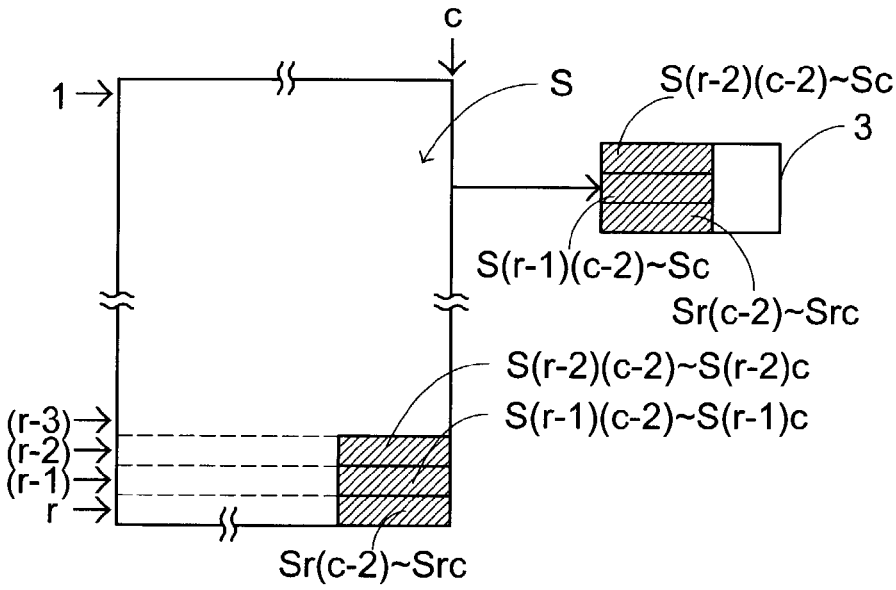

A third preferred embodiment of the present invention will be depicted with reference to FIGS. 4(*a*) to 4(*c*) and FIGS. 5(*a*) to 5(*n*). In this embodiment, an image frame consisting of r rows and c columns of data is to be processed, a frame buffer register capable of storing at most u rows and v columns of data is provided, and an image portion selected from the image frame and consisting of i rows and j columns of data is to be stored to and scaled in the frame buffer register by the microprocessor, where r, c, u, v, i and j are integers, $1 \leqq i \leqq u < r$, and $1 \leqq j \leqq v < c$.

The steps for performing this embodiment are shown in the flowcharts and described hereinafter assuming $i>1$ and $j>1$.

In Step (b1), the image frame is stored into a memory by a microprocessor. A small block of the image frame consisting of the first row and the first column of data is picked into the frame buffer register in Step (b2). Then, Steps (b5) and (b6) are executed according to the judging criteria of Step (b4). Step (b5) is repetitively executed for image blocks of the same row but adjacent columns until the image block consisting of the first row and the jth column has been stored to the frame buffer register. Step (b6) is executed to store image blocks consisting of the second row and the first to jth columns. Step (b6) will be repetitively executed until the image block consisting of the ith row and the jth column is stored to the frame buffer register on the basis of the judging criteria of Step (b8), thereby storing the complete image portion consisting of the first to the ith rows and the first to the jth columns of data to the frame buffer register. Meanwhile, Steps (b9) and (b10) are executed to complete the scaling operation of the image portion.

The above steps are repeated for the following image blocks. If the selected image portion consists of less than i rows and/or j columns, Step (b3), Step (b7) and/or Step (b11) are used to determine whether the selected image portion is the last one of the image frame, i.e. whether the selected image portion includes the rth row and the cth column of data. If negative, the previous steps are properly repeated. If positive, the entire scaling operation of the image frame is completed after the last image frame is scaled in the Step (b15).

FIGS. 5(*a*) to 5(*n*) are schematic diagrams illustrating the transmission sequences of image portions of an image frame to a frame buffer block by block according to the method of FIGS. 4(*a*)~4(*c*). In this example, i=3 and j=3.

As shown in FIGS. 5(*a*) to 5(*c*), image blocks S11, S12 and S13 respectively consisting of the first row and the first column of data, the first row and the second column of data, the first row and the third column of data, are one by one picked into the frame image buffer 3. Likewise, S21~S23 and S31~S33 of the next two rows of data are picked into the frame buffer register 3, as shown in FIG. 5(*f*). The image portion is scaled and then stored back to the memory. Then, the above steps are repeated for the following image portions until the last image portion including the rth row and the cth column of data is processed, as referred to FIGS. 5(*g*) to 5(*n*). In order to make the scaled image look more smooth and natural, one or more interfacing rows or columns between two adjacent image portions can be included in both of the image portions to be processed twice.

From the above description, it is understood that a relatively small memory size of a frame buffer register is used to achieve a high compressing rate or scaling-up rate according to the present invention without deteriorating the quality of a displayed image.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A method for scaling an image frame comprising steps of:

(a) storing an image frame consisting of n rows and m columns of data;

(b) performing a first-dimension and a second-dimension image scaling operations on a first image portion of said image frame, said first image portion including the first to the pth rows and the first to the qth columns of data, where $1<p \leqq n$ and $1<q \leqq m$;

(c) performing said first-dimension and said second-dimension image scaling operations on a second image portion of said image frame after said step (b) if said p is not equal to n, said second image portion including the ath to tth rows and the first to the bth columns of data, where $1<a<t \leqq n$, $t>p$, and $1<b \leqq m$; and (d) performing said first-dimension and said second-dimension image scaling operations on a third image portion of said image frame after said step (c) if said q is not equal to m, said third image portion including the first to dth rows and the eth to the fth columns of data, where $1<e<f \leqq m$, $f>q$, and $1<d \leqq n$.

2. The method according to claim 1 further comprising a step (c1) before said step (d) of performing said first-dimension and said second-dimension image scaling operations on a fourth image portion of said image frame if said t is not equal to n, said fourth image portion including at least the nth row and the first to the gth columns of data, where $1<g \leqq m$.

3. The method according to claim 1 wherein g=b=q.

4. The method according to claim 1 wherein a=p+1, and t=2p.

5. The method according to claim 1 wherein e=q+1, and f=2q.

6. The method according to claim 1 further comprising a step (d1) after said step (d) of performing said first-dimension and said second-dimension image scaling operations on a fifth image portion of said image frame if said f is not equal to m, said fifth image portion including at least the nth row and the mth columns of data.

7. The method according to claim 1 wherein said first-dimension and said second-dimension image scaling operations are performed for all of said n rows and m columns of said image frame.

8. The method according to claim 7 wherein said first image portion is a top left or top right block of said image frame, and said fifth image portion is correspondingly a bottom right or bottom left block of said image frame.

9. The method according to claim 7 wherein said first image portion is a bottom left or bottom right block of said image frame, and said fifth image portion is correspondingly a top right or top left block of said image frame.

10. The method according to claim 1 further comprising a step of storing an image portion to proceed said first-dimension and said second-dimension image scaling operations in a one-way queue.

11. The method according to claim 1 wherein each of said first image portion, said second image portion, and said third image portion consists of at least two rows and at least two columns of data.

12. The method according to claim 1 wherein said first dimension and said second dimension are a horizontal dimension and a vertical dimension.

13. The method according to claim 1 wherein each of said first-dimension and said second-dimension image scaling operations is an algorithm selected from a group consisting of weighted average, interpolation, extrapolation and a combination thereof.

14. A method for scaling an image frame comprising steps of:

(a) dividing an image frame into a series of first image portions horizontally adjacent to one another, and dividing each of said first image portions into a series of second image portions vertically adjacent to one another, wherein each of said second image portions includes at least two rows and at least two columns of data; and (b) performing a first-dimension and a second-dimension image scaling operations on each of said second image portions one by one in the same first image portion and then moving onto next first image portions to perform said first-dimension and said second-dimension image scaling operations of said second image portions, until all of said second image portions in said image frame complete said first-dimension and second-dimension image scaling operations wherein said first dimension and said second dimension are a horizontal and a vertical dimension.

15. The method according to claim 14 wherein each of said first-dimension and said second-dimension image scaling operations is an algorithm selected from a group consisting of weighted average, interpolation, extrapolation and a combination thereof.

16. A method for scaling an image frame comprising steps of:

(a) storing an image frame consisting of n rows and m columns of data into a storage device;

(b) dividing said image frame into a plurality of image portions, a first one of said image portions including data common to at least the first row and the first column of said image frame, a second one of said image portions including data common to at least a part of the nth row and the first column of said image frame, a third one of said image portions including data common to at least a part of the first row and the mth column of said image frame, and a fourth one of said image portions including data common to at least a part of the nth row and the mth column of said image frame; and (c) picking said first, second, third and fourth ones of said image portions in sequence to a frame buffer register, sequentially performing an image scaling operation for each said picked image portion, and then clearing said scaled image portion from said frame buffer register.

17. The method according to 16 wherein said image frame includes a fifth image portion vertically between said first and second ones of said image portions, which is picked following said first one of said image portions and prior to said second one of said image portions.

18. The method according to 16 wherein said image frame includes a sixth image portion horizontally between said first and third ones of said image portions, which is picked following said second one of said image portions and prior to said third one of said image portions.

19. The method according to 16 wherein in said step (c), each of the first, second, third and fourth ones of said image portions is picked to a frame buffer register in a sequence of picking a first row of data column by column and then moving onto next row to pick the data column by column.

* * * * *